US011267102B2

(12) United States Patent
Loutfy et al.

(10) Patent No.: US 11,267,102 B2
(45) Date of Patent: Mar. 8, 2022

(54) ALUMINUM DIAMOND CUTTING TOOL

(71) Applicant: Nano Materials International Corporation, Tucson, AZ (US)

(72) Inventors: Omar Kevin Loutfy, Tucson, AZ (US); Raouf Loutfy, Tucson, AZ (US); Birol Sonuparlak, Chandler, AZ (US)

(73) Assignee: Nano Materials International Corporation, Tucson, AZ (US)

( * ) Notice: Subject to any disclaimer, the term of this patent is extended or adjusted under 35 U.S.C. 154(b) by 187 days.

(21) Appl. No.: 15/503,058

(22) PCT Filed: Aug. 25, 2015

(86) PCT No.: PCT/US2015/046750

§ 371 (c)(1),
(2) Date: Feb. 10, 2017

(87) PCT Pub. No.: WO2016/033080

PCT Pub. Date: Mar. 3, 2016

(65) Prior Publication Data

US 2017/0232579 A1 Aug. 17, 2017

Related U.S. Application Data

(60) Provisional application No. 62/041,789, filed on Aug. 26, 2014.

(51) Int. Cl.
*B24D 3/08* (2006.01)
*B24D 99/00* (2010.01)

(52) U.S. Cl.
CPC ..... *B24D 3/08* (2013.01); *B24D 99/005* (2013.01)

(58) Field of Classification Search
CPC ..... B24D 3/08
USPC ..... 451/540, 541, 546
See application file for complete search history.

(56) References Cited

U.S. PATENT DOCUMENTS 3,540,162 A * 11/1970 Blackmer ..... B24D 3/08 451/547
3,663,191 A * 5/1972 Kroder ..... B24D 18/00 428/643
4,787,362 A * 11/1988 Boucher ..... B23D 61/028 125/15

(Continued)

FOREIGN PATENT DOCUMENTS

JP 825112 1/1996
JP 2012117085 6/2012

(Continued)

OTHER PUBLICATIONS

International Search Report filed in PCT/US15/46750 dated Nov. 19, 2015.

(Continued)

*Primary Examiner* — Joel D Crandall
(74) *Attorney, Agent, or Firm* — Rankin, Hill & Clark LLP

(57) ABSTRACT

A novel diamond cutting tool and its use in cutting and grinding applications. The cutting surface of the tool is composed of an aluminum/diamond metal matrix composite comprising diamond particles dispersed in a matrix of aluminum or an aluminum alloy, and wherein the diamond particles have thin layers of beta-SiC chemically bonded to the surfaces thereof.

28 Claims, 1 Drawing Sheet

(56) References Cited

U.S. PATENT DOCUMENTS 5,435,815 A * 7/1995 Ikegaya ..... B23P 15/28 51/295
5,733,074 A * 3/1998 Stock ..... B23B 37/00 408/17
6,319,109 B1 * 11/2001 Fujii ..... B24D 3/08 451/541
6,416,560 B1 * 7/2002 Palmgren ..... B24D 3/10 51/293
6,599,178 B1 7/2003 Gluche et al.
6,673,439 B1 * 1/2004 Miyamoto ..... C30B 33/00 428/336
6,851,418 B2 * 2/2005 Takemura ..... B23C 5/1009 125/36
7,257,877 B2 8/2007 Hanaoka et al.
7,279,023 B2 * 10/2007 Pickard ..... C22C 26/00 257/708
7,641,709 B2 1/2010 Pickard et al.
7,988,758 B2 8/2011 Pickard et al.
8,628,385 B2 * 1/2014 Wu ..... B24D 3/346 451/28
2012/0055097 A1 * 3/2012 Tian ..... B23K 1/0056 51/309
2012/0055717 A1 * 3/2012 Liversage ..... C04B 41/4529 175/428
2012/0063071 A1 * 3/2012 Loutfy ..... C09K 3/1436 361/679.01
2012/0080239 A1 4/2012 Lyons et al.
2012/0199402 A1 * 8/2012 Rupp ..... E21B 10/48 175/434

FOREIGN PATENT DOCUMENTS

WO WO-9323204 A1 * 11/1993 ..... B21C 3/025
WO 200121862 3/2001

OTHER PUBLICATIONS

Office Action of Japanese Serial No. 2017-511301 dated Mar. 31, 2019, 4 pages.

* cited by examiner

ALUMINUM DIAMOND CUTTING TOOL

This application claims the benefit of U.S. Provisional Application No. 62/041,789, filed Aug. 26, 2014, incorporated herein by reference.

FIELD OF THE INVENTION

This invention relates to a diamond cutting tool and, more specifically, to a diamond cutting tool in which the diamond-containing cutting surface is in the form of an aluminum/diamond metal matrix composite.

BACKGROUND OF THE INVENTION

Diamond cutting tools employed in the cutting and grinding of various workpieces, utilize to advantage the unique combination of properties exhibited by diamond, including extreme hardness, high strength, and good wear resistance. Such tools are typically fabricated using diamond particles, also referred to as diamond grits or diamond segments, which are bonded to a metal core, such as aluminum or steel. The diamond is bonded to the core typically by two methods, using either resin or nickel bonding. For nickel, the diamond is electroplated with nickel and this is heated and melted to cause attachment to the core and each other. For resin, the diamond is embedded in the resin and the resin provides attachment to the core and each other.

Whether nickel-bonded or resin-bonded, the prior art diamond cutting tools leave some room for improvement in several significant respects. One of the problems associated with these prior art tools is that they tend to exhibit a relatively weak diamond grain-matrix bond strength and as a result of the low shear stress handling abilities of both nickel and resin. Another problem is that they have relatively poor thermal conductivity, resulting in higher tool temperature during operation, which leads to the eventual premature wear of the tool. Yet another problem is that they do not allow for a thick layer of diamond, which means that when these thin diamond layers are depleted, the tool has to be discarded or sent back for reattachment of the diamond layer. And a still further problem occurs when the diamond is worn flat during operation and the diamond particles must be re-sharpened or dressed to expose new cutting edges. For nickel- or resin-bonded diamond tools, this is accomplished by mechanical dressing, in which an abrasive material is run against the spinning tool to expose fresh cutting edges. This removes not an insignificant amount of diamond due to "pull-out" of the diamond from the nickel or resin bonding material.

Aluminum/diamond metal matrix composites (Al/Diamond MMCs), comprising diamond particles dispersed in a matrix of aluminum or an aluminum alloy, and made by infiltrating a porous diamond preform with molten aluminum or aluminum alloy, are well-known materials whose primary use has been as heat-dissipating substrates for containing or supporting electronic devices such as integrated circuit elements for which high thermal conductivity, controllable coefficient of thermal expansion (CTE), and light weight are all important.

An improved method for producing higher thermal conductivity Al/Diamond MMCs and other metal/diamond metal matrix composites from a metal-infiltrated porous diamond preform, is described in the Pickard et al. U.S. Pat. Nos. 7,279,023, 7,641,709 and 7,988,758, all of which are incorporated herein by reference in their entireties. In accordance with the Pickard et al. method, a diamond preform component of the metal matrix composite is optimized for use in aluminum or other metal matrix, by first providing the diamond particles with thin layers of beta-SiC chemically bonded to the surfaces thereof. The SiC layer is produced in-situ on the diamond particles of the diamond preform that is then embedded in the metal matrix by a rapid high pressure metal infiltration technique such as squeeze casting or gas pressure infiltration. Preferably, the chemically bonded layer of SiC is produced on the diamond particles by a chemical vapor reaction process (CVR) by contacting the diamond particles with SiO gas. Such SiC-coated diamond particles when employed in metal matrix composites offer significantly improved thermal conductivity performance compared to uncoated diamond particles, with reported thermal conductivity of the resultant MMC greater than about 500 W/mK and as high as about 650 W/mK. The SiC layers also serve to significantly improve the mechanical bond strength between the diamond particles and the metal matrix.

SUMMARY OF THE INVENTION

The present invention utilizes in a novel way the higher thermal conductivity Al/Diamond MMCs with SiC-coated diamond particles described in the above-referenced Pickard et al. U.S. patents, thereby to provide a novel diamond cutting tool for use in cutting and grinding operations. The novel diamond cutting tool in accordance with the present invention comprises a cylindrical outer diamond-containing cutting surface bonded to an inner metal core, wherein the cutting surface is composed of an aluminum/diamond metal matrix composite comprising diamond particles dispersed in a matrix of aluminum or an aluminum alloy, and wherein the diamond particles have thin layers of beta-SiC chemically bonded to the surfaces thereof.

For use in cutting or grinding operations, the diamond cutting tool in accordance with the present invention is coupled to an apparatus for rotating the tool, such as a grinder, mill or drill press, through a cylindrical metal shank member formed as an integral unit with the tool's inner metal core or otherwise secured to the core. The rotating tool may then be used in the machining of various types of workpieces for various applications, including optical glass for applications such as smart phone screens and lenses and prisms for optical systems such as cameras; ceramics such as boron carbide, alumina, silicon carbide and silicon nitride for applications such as ballistic armor materials; porous ceramics to shape them for particular application such as furnace fixtures; core drill rocks for mining or crude oil well drill applications; drills for medical and dental applications; transparent ceramics such as sapphire, spinel and AION for applications such as armor windows, missile domes and scratch resistant windows used in watches and phones; and silicon wafers for applications such as silicon wafer micromachining for re-work purposes.

The diamond cutting tool in accordance with the present invention, with its Al/Diamond MMC cutting surface, offers a number of advantages over the prior art nickel- or resin-bonded diamond tools described above. Due to the bonding enhancement provided by the SiC layers on the diamond particles, the Al/Diamond MMC exhibits a much stronger mechanical strength than that achievable with nickel or resin. Also, the extremely high thermal conductivity of the Al/Diamond MMC of greater than about 500 W/mK, leads to rapid cooling of the tool during operation, greatly prolonging overall tool life. In addition, the Al/Diamond MMC cutting surface is capable of being formed in much greater thickness, ranging from about 0.020 to about 1.00 inch, than the nickel- or resin-bonded cutting surfaces, leading to a much longer tool life. Furthermore, the Al/Diamond MMC cutting surface can be sharpened in addition to mechanical dressing as it is done for the nickel- and resin-bonded cutting surfaces, it may also be sharpened or dressed chemically. The tool is simply placed in a dilute solution of hydrochloric acid, sulfuric acid, potassium hydroxide,or sodium hydroxide, causing the aluminum to be removed and fresh sharp diamond edges exposed. This chemical treatment does not lead to diamond "pull-out" and is fast and easy to accomplish, leading to a paradigm shift in diamond cutting tool maintenance.

DESCRIPTION OF DEPICTED EMBODIMENTS

Figure 1:
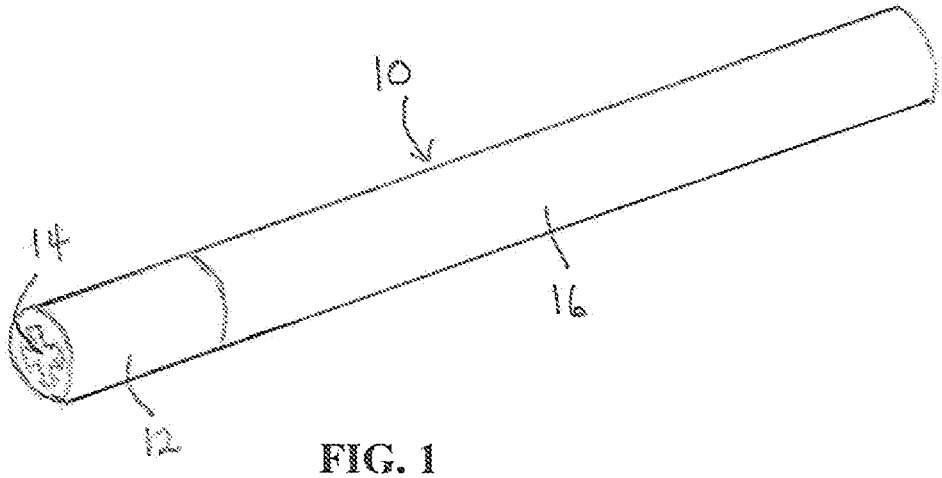
FIG. 1 is a perspective view of a typical diamond cutting tool in accordance with the present invention.
Figure 3:
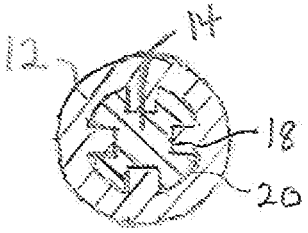
FIG. 3 is a transverse sectional view of the diamond cutting tool of FIG. 2 taken along section line 3-3 of FIG. 2.
Figure 2:
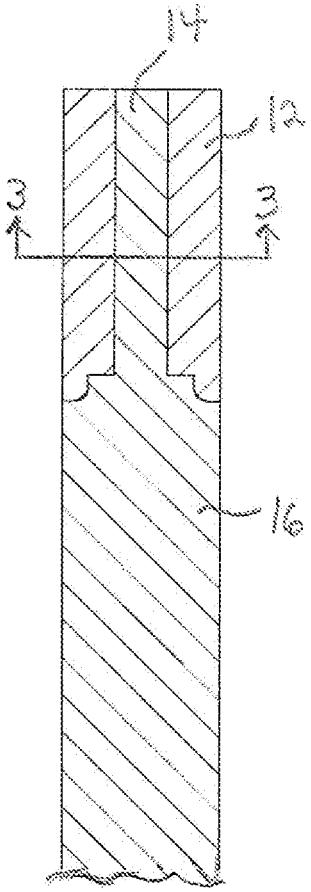
FIG. 2 is an enlarged schematic view of a portion of the diamond cutting tool of FIG. 1.

A typical diamond cutting tool 10 in accordance with the present invention is illustrated in FIG. 1. As shown in detail in FIGS. 2 and 3, the cutting tool 10 comprises a cylindrical outer diamond-containing cutting surface 12 bonded to an inner metal core 14. A cylindrical metal shank member 16 is secured at one end thereof to the core 14. In the depicted embodiment, as best shown in FIG. 2, the shank member 16 is formed as an integral unit with the core 14, but may be a separate piece otherwise secured to the core 14, for example, by means of a threaded connection. As shown in FIG. 3, the cutting surface 12 and core 14 are each provided with interlocking grooves 18 and protrusions 20 for improved bonding between them. Although it should be appreciated that alternative manners for improving the bonding between the cutting surface 12 and the core 14 are contemplated, the surface of core 14 can also be roughened by a knurling process or an alternative interlocking shape such as threading to improve bonding with surface 12.

The heart of the present invention resides in utilizing, as the diamond-containing material of the cutting surface 12, an aluminum/diamond metal matrix composite comprising diamond particles dispersed in a matrix of aluminum or an aluminum alloy, and wherein the diamond particles have thin layers of beta-SiC chemically bonded to the surfaces thereof. This is an entirely new use for these Al/Diamond MMCs, whose previously known use was primarily as a heat-dissipating substrate in electronic applications. It has now been surprisingly discovered that the extremely high thermal conductivity and enhanced bond mechanical strength attributed to the SiC layers on the diamond particles help to render these Al/Diamond MMCs equally attractive as a diamond cutting tool cutting surface.

The core 14/shank member 16 combination is formed of a material that is easily machinable, has a coefficient of thermal expansion (CTE) similar to that of the Al/Diamond MMC so as to form a firm bond therewith and not impart undue thermally induced stresses so as to prevent premature failure and minimize dimensional change during heating or cooling, and has a dimensionally true cylindrical region for attaching the tool to the apparatus rotating the tool. Preferred materials are titanium, stainless steel, zirconium and molybdenum.

Fabrication of the diamond cutting tool of the present invention is carried out in a two-piece tooling designed to hold in place the core or core/shank member combination and create a pocket around the core in which the SiC-coated diamond particles can be packed for infiltration with molten aluminum. The tooling needs to have porosity or gates to allow the flow of molten aluminum to enter, encompass and coat the diamond particles. The tooling also needs to be dimensionally stable and be compatible with the temperature used in aluminum casting (800° C.) and also the CTE of the Al/Diamond MMC to ensure that undue break-inducing stresses are not placed on the MMC or tooling during the heating and cooling process of production, the casting does not get stuck due to being rigidly constrained by the tooling, and the tooling is re-usable in subsequent castings. For these reasons, the tooling is typically made from graphite, graphite/Al which has a CTE between 5-8 ppm/K, and/or titanium which has a CTE between 8.5-10.0 ppm/K.

The SiC-coated diamond particles employed in fabricating the diamond cutting tool of the present invention are those formed by a chemical vapor reaction of SiO with the diamond particles, as described in detail in the above-referenced Pickard et al. U.S. patents incorporated herein by reference. The particle size of the diamond particles will vary based on the cutting requirements of the tool being fabricated. For example, for coarse grinding, coarse diamond particles having an average particle size of about 150 micron can be used, whereas fine diamond particles having an average particle size of about 15 micron can be used for fine grinding. A wide range of diamond particle sizes in between, smaller, or larger than these example sizes can be used based on the application need such as between 5 micron to 300 micron.

Aluminum is infiltrated into the tooling containing the SiC-coated diamond particles and the core or core/shank member combination, by a pressure infiltration process which may be either squeeze casting or gas pressure infiltration. Both processes involve the melting of aluminum around the tooling, a die or can that contains the tooling, and the application of high pressure (>800 psi) to force the molten aluminum through the tooling porosity and/or gates to encompass the diamond particles and provide the finished cast part geometry. The aluminum used can be pure aluminum or an aluminum alloy, preferably an alloy of aluminum containing silicon as the second major component.

The relative proportions of aluminum and diamond particles employed in the tool fabrication should be such as to provide a diamond particle concentration in the formed Al/Diamond MMC within the range of from about 20 to about 80 volume percent, preferably from about 55 to about 70 volume percent.

The above-described fabrication process can be used to produce diamond cutting tools with Al/Diamond MMC cutting surfaces of varying thickness ranging from about 0.020 inch to about 1.00 inch and exhibiting strong bond mechanical strength and extremely high thermal conductivity of greater than about 500 W/mK. When coupled through its shank member to an apparatus for rotating the tool, such as a grinder, mill, or drill press, the rotating tool may be used in the machining of various types of workpieces for various applications as listed above. Certain of these applications may, however, require some fine tuning of the tool to achieve the necessary tolerance level not achievable by the casting fabrication process described above.

Castings inherently have tolerances that can be in the range of 0.005" to 0.010". These casting tolerances, when present on a rotating tool, can cause run-out that is too much for certain cutting/grinding applications. Precision optical grinding applications, for example, require a run-out of approximately 10 micron (393 micro inch, 0.00039"). Furthermore, some features, such as grooves, can be difficult to cast, as they might prevent the cast cutting tool from coming out of the tooling used in fabrication. For these types of situations, rotary wire EDM machining of the tool would be the remedy and would also leave a surface with exposed diamond, necessary for cutting tool application. When the diamond becomes worn from cutting, the tool can be redressed by dissolving the aluminum and thus exposing fresh diamond surfaces. This can be done by simply dipping the cutting surface of the tool in acidic or basic solutions that are known to dissolve aluminum, such as dilute solutions of hydrochloric acid, sulfuric acid, potassium hydroxide, or sodium hydroxide.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for machining a workpiece comprising:

fabricating a diamond cutting tool by a pressure infiltration of molten aluminum or an aluminum based alloy in a cylindrical compact of SiC-coated diamond particles surrounding an inner metal core, thus providing a cylindrical diamond cutting tool comprising an outer diamond-containing cutting surface bonded to the inner metal core, wherein said outer diamond-containing cutting surface is composed of an aluminum/diamond metal matrix composite comprising diamond particles dispersed in a matrix of aluminum or aluminum based alloy;

cutting or grinding said workpiece with the rotating diamond cutting tool; and redressing the cutting tool by at least partially dissolving the matrix of aluminum or aluminum based alloy to expose additional diamond particles dispersed in said matrix.

2. The method of claim 1, wherein said aluminum/diamond metal matrix composite has a thermal conductivity of greater than about 500 W/mK.

3. The method of claim 1, wherein said outer diamond-containing cutting surface has a thickness of from about 0.020 inch to about 1.00 inch.

4. The method of claim 1, wherein the diamond particles have thin layers of beta-SiC chemically bonded to surfaces thereof, and the beta-SiC layers are comprised of a conversion coating formed by a chemical vapor reaction of SiO with the diamond particles.

5. The method of claim 1, wherein said matrix is an aluminum based alloy containing silicon as a second major component.

6. The method of claim 1, wherein a concentration of diamond particles in said aluminum/diamond metal matrix composite is within a range of from about 20 to about 80 volume percent.

7. The method of claim 6, wherein said diamond particles concentration is within a range of from about 55 to about 70 volume percent.

8. The method of claim 1, wherein said diamond particles are coarse diamond particles having an average particle size of about 150 micron.

9. The method of claim 1, wherein said diamond particles are fine diamond particles having an average particle size of about 15 micron.

10. The method of claim 1, wherein said inner metal core is formed of titanium, stainless steel, zirconium or molybdenum.

11. The method of claim 1, wherein said outer diamond-containing cutting surface and said inner metal core are each provided with interlocking grooves or protrusions for improved bonding between them.

12. The method of claim 1, wherein said diamond cutting tool also includes a cylindrical metal shank member secured at one end thereof to said inner metal core and coupled at its other end to an apparatus for rotating said tool.

13. The method of claim 12, wherein said shank member is formed as an integral unit with said inner metal core.

14. A diamond cutting tool comprising a cylindrical outer diamond-containing cutting surface formed by a pressure infiltration of molten aluminum or an aluminum based alloy in a cylindrical compact of SiC-coated diamond particles and bonded to an inner metal core, said outer diamond-containing cutting surface being composed of an aluminum/diamond metal matrix composite comprising diamond particles dispersed in a matrix of aluminum or an aluminum based alloy, wherein said outer diamond-containing cutting surface and said inner metal core are each provided with interlocking grooves or protrusions for improved bonding between them.

15. The diamond cutting tool of claim 14, wherein said aluminum/diamond metal matrix composite has a thermal conductivity of greater than about 500 W/mK.

16. The diamond cutting tool of claim 14, wherein said outer diamond-containing cutting surface has a thickness of from about 0.020 inch to about 1.00 inch.

17. The diamond cutting tool of claim 14, wherein the diamond particles have thin layers of beta-SiC chemically bonded to surfaces thereof, and the beta-SiC layers are comprised of a conversion coating formed by a chemical vapor reaction of SiO with the diamond particles.

18. The diamond cutting tool of claim 14, wherein said matrix is an aluminum based alloy containing silicon as a second major component.

19. The diamond cutting tool of claim 14, wherein a concentration of diamond particles in said aluminum/diamond metal matrix composite is within a range of from about 20 to about 80 volume percent.

20. The diamond cutting tool of claim 19, wherein said diamond particles concentration is within a range of from about 55 to about 70 volume percent.

21. The diamond cutting tool of claim 14, wherein said diamond particles are coarse diamond particles having an average particle size of about 150 micron.

22. The diamond cutting tool of claim 14, wherein said diamond particles are fine diamond particles having an average particle size of about 15 micron.

23. The diamond cutting tool of claim 14, wherein said inner metal core is formed of titanium, stainless steel, zirconium or molybdenum.

24. The diamond cutting tool of claim 14, further including a cylindrical metal shank member secured at one end thereof to said inner metal core.

25. The diamond cutting tool of claim 24, wherein said shank member is formed as an integral unit with said inner metal core.

26. A method for machining a workpiece comprising:

fabricating a diamond cutting tool by a pressure infiltration of molten aluminum or an aluminum based alloy in a cylindrical compact of SiC-coated diamond particles surrounding an inner metal core, thus providing a cylindrical diamond cutting tool comprising an outer diamond-containing cutting surface bonded to the inner metal core, wherein said outer diamond-containing cutting surface is composed of an aluminum/diamond metal matrix composite comprising diamond particles dispersed in a matrix of aluminum or aluminum based alloy; and cutting or grinding said workpiece with the rotating diamond cutting tool;

wherein said outer diamond-containing cutting surface and said inner metal core are each provided with interlocking grooves or protrusions for improved bonding between them.

27. The method of claim 26, wherein said matrix is an aluminum based alloy containing silicon as a second major component, and said inner metal core is formed of titanium, stainless steel, zirconium or molybdenum.

28. The method of claim 26, including redressing the cutting tool by at least partially dissolving the matrix of aluminum or aluminum based alloy to expose additional diamond particles dispersed in said matrix.

* * * * *